US008353075B2

(12) United States Patent
Kemp

(10) Patent No.: US 8,353,075 B2
(45) Date of Patent: Jan. 15, 2013

(54) ORAL CARE IMPLEMENT

(75) Inventor: James Herbert Kemp, Basking Ridge, NJ (US)

(73) Assignee: Colgate-Palmolive Company, New York, NY (US)

( * ) Notice: Subject to any disclaimer, the term of this patent is extended or adjusted under 35 U.S.C. 154(b) by 958 days.

(21) Appl. No.: 12/159,331

(22) PCT Filed: Jun. 3, 2008

(86) PCT No.: PCT/US2008/065625

§ 371 (c)(1),
(2), (4) Date: Jun. 28, 2008

(87) PCT Pub. No.: WO2009/148439

PCT Pub. Date: Dec. 10, 2009

(65) Prior Publication Data

US 2010/0263146 A1 Oct. 21, 2010

(51) Int. Cl.
*A46B 7/06* (2006.01)
*A46B 9/04* (2006.01)

(52) U.S. Cl. ..... 15/167.1; 15/110; 15/172; 15/201

(58) Field of Classification Search ..... 15/106, 15/110, 167.1, 201, 172
See application file for complete search history.

(56) References Cited

U.S. PATENT DOCUMENTS

| | | | | |
|---|---|---|---|---|
| 3,188,672 | A * | 6/1965 | Gary | 15/167.1 |
| 3,994,038 | A * | 11/1976 | Moulet | 15/167.1 |
| 4,776,054 | A | 10/1988 | Rauch | |
| 4,776,055 | A | 10/1988 | Nelson | |
| 5,651,158 | A * | 7/1997 | Halm | 15/167.1 |
| 5,799,354 | A * | 9/1998 | Amir | 15/167.1 |
| 5,813,079 | A * | 9/1998 | Halm | 15/167.1 |
| 6,219,874 | B1 | 4/2001 | Van Gelder | |
| 6,286,173 | B1 | 9/2001 | Briones | |
| 6,553,604 | B1 * | 4/2003 | Braun et al. | 15/167.1 |
| 7,140,058 | B2 | 11/2006 | Gatzemeyer et al. | |
| 7,607,189 | B2 * | 10/2009 | Moskovich | 15/111 |
| 7,975,344 | B2 * | 7/2011 | Braun et al. | 15/110 |
| 2006/0129171 | A1 | 6/2006 | Moskovich | |

FOREIGN PATENT DOCUMENTS

| | | |
|---|---|---|
| CN | 2761028 | 3/2006 |
| EP | 1 486 137 A | 12/2004 |
| FR | 2040545 | 1/1971 |
| WO | WO 96/02165 | 2/1996 |
| WO | 97/07707 A | 3/1997 |
| WO | WO 01/45573 | 6/2001 |
| WO | WO 2007/009276 | 1/2007 |

OTHER PUBLICATIONS

Copy of International Search Report PCT/US2008/065625 Mailed Feb. 18, 2009.

* cited by examiner

*Primary Examiner* — Randall Chin

(57) ABSTRACT

An oral care implement or toothbrush includes a head, tooth cleaning elements and tissue cleansing elements. The tooth cleaning elements may be provided on a first face of the toothbrush head while the tissue cleansing elements may be disposed on a second face of the head. The head may further include one or more splits that provide flexible and non-flexible regions. Various configurations of splits may be used to create different effects such as more responsive flexion, regions of differing flexibility and/or different degree of flexion.

19 Claims, 4 Drawing Sheets

ORAL CARE IMPLEMENT

BACKGROUND OF THE INVENTION

The present invention pertains to an oral care implement with a tissue cleanser and a medicament for engaging tissue of the mouth. According to the American Dental Association, a major source of bad breath in healthy people is microbial deposits on the tongue, where a bacterial coating harbors organisms and debris that contribute to bad breath. Tissue in the mouth, and especially the tongue, is a haven for the growth of microorganisms. The papillary nature of the tongue surface creates a unique ecological site that provides an extremely large surface area, favoring the accumulation of oral bacteria. Anaerobic flora and bacteria residing on the tongue and other soft tissues in the mouth play an important role in the development of chronic bad breath commonly called halitosis. In general, the bacteria produce volatile sulfur compounds (VSC). If there is enough buildup of the sulfur compounds, the result can be bad breath or oral malodor.

BRIEF SUMMARY OF THE INVENTION

The invention pertains to an oral care implement having a flexible tissue cleanser which provides improved cleaning and effective removal of bacteria and microdebris disposed on the oral tissue surfaces.

According to one aspect, a portion of the oral care implement having the tissue cleanser such as a toothbrush head includes at least one split that provides flexibility to a region of the oral care implement. According to another aspect, splits in the toothbrush head or other portion of an oral care implement may be filled with an elastomeric or flexible filler material to connect the two portions of the head divided by the split. According yet another aspect, splits in an oral care implement may be asymmetric, providing different cleansing abilities and flexibility.

Other features and advantages of the invention will become apparent from the following description taken in conjunction with the following drawings.

DETAILED DESCRIPTION OF THE INVENTION

In the following description, the invention is discussed in terms of a toothbrush, but could be in the form of other oral care implements including simply a tissue cleansing implement. Further, it is understood that other embodiments may be utilized and structural and functional modifications may be made without departing from the scope of the present invention.

Figure 1:
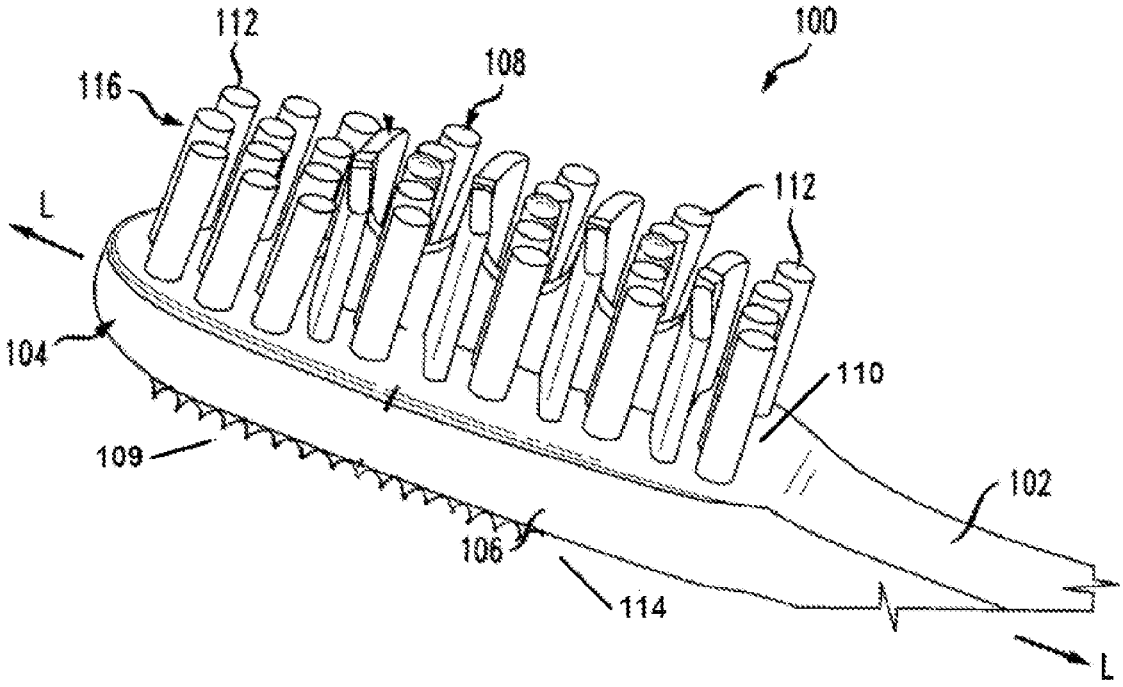
FIG. 1 is a perspective view of a toothbrush according to one or more aspects of an illustrative embodiment, a handle of the toothbrush being partially shown.
Figure 2:
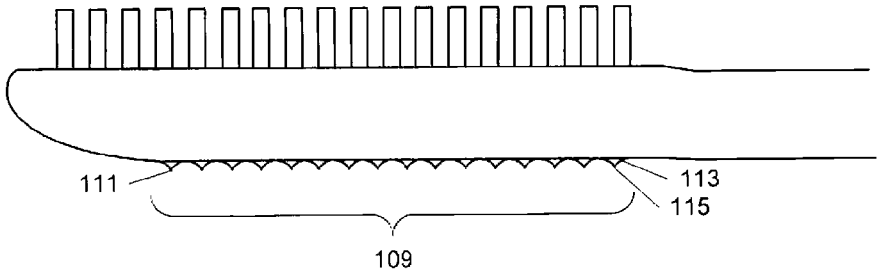
FIG. 2 is side view of the toothbrush of FIG. 1.
Figure 3:
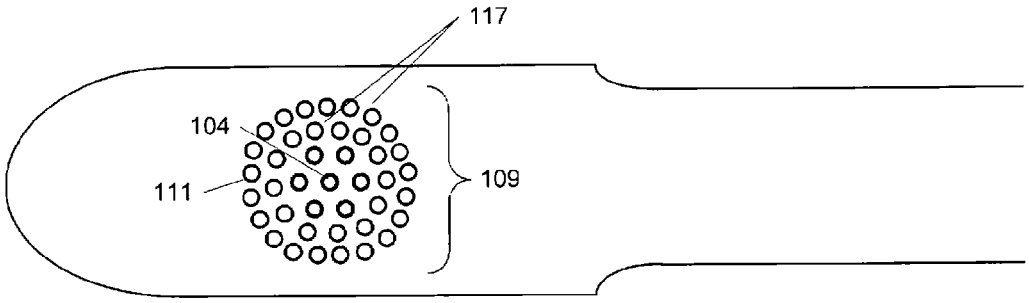
FIG. 3 is a rear view of a toothbrush having a tissue cleansing element arrangement.

FIGS. 1-3 illustrate an oral care implement, or toothbrush, of the present invention, generally designated with the reference numeral 100. The toothbrush 100 generally includes a handle 102 and a head 104. The toothbrush 100 generally has a longitudinal axis L.

The handle 102 is generally an elongated member that is dimensioned for the user to readily grip and manipulate the toothbrush 100. The handle 102 may be formed of many different shapes, lengths and with a variety of constructions. The handle 102 may have a neck portion directly adjacent to the head 104. In one construction, the handle 102 is integrally formed with the head 104 although other attachment configurations are possible.

The head 104 generally includes a support member 106 and a plurality of tooth cleaning elements 108 extending from a first side or face, e.g., side 110 of head 104. The plurality of tooth cleaning elements 108 may include cleaning elements of varying shapes, sizes and materials. The support member 106 is typically integrally formed with the handle 102 and supports the tooth cleaning elements 108. The tooth cleaning elements 108 may be considered to be connected to the head 104. In one embodiment, the first tooth cleaning element 108 is formed from a plurality of bristles 112 (FIG. 1). While FIG. 1 shows the tooth cleaning elements 108 as bristles having a larger diameter, it is understood that bristles 112 may be in the form of tufts of bristles 112 wherein bristles 112 have substantially smaller diameters. Other configurations of the bristles 112 are also possible, as are known. As shown in FIG. 1, tooth cleaning elements 108 extend from side 110 of support member 106 and have distal ends that generally define a distal region 116 of the head 104. It is understood that the respective lengths of tooth cleaning elements 108 can be independently varied as desired. The tooth cleaning elements 108 can be attached to the support member 106 by known methods, such as being fit within recesses formed in the support member 106.

It is understood that the bristles 112 may be made from nylon although other materials could be used. The bristles 112 also have a generally circular cross-sectional shape, but could have other cross-sectional shapes as well. The diameter of the bristles 112 can vary depending on the desired cleaning action of the bristles 112.

Head 104 further includes tissue cleanser 109 that is configured for cleaning oral tissues such as a user's tongue. In the arrangement of FIGS. 1-3, tissue cleanser 109 extends from a second side, i.e., side 114, opposite side 110, of head 104. Such an arrangement allows a user to brush their teeth using side 110 of toothbrush 100 and to clean their tongue or other soft oral tissue using side 114. Additionally or alternatively, tissue cleanser 109 may be disposed in other locations of the toothbrush including at an end of handle 102 furthest from head 104, along the edges of the toothbrush and the like. Separating tissue cleaner 109 from tooth cleaning elements 108 may prevent injury or discomfort that may result from scraping and/or damaging soft oral tissue using tooth cleaning elements 108. Further, the relative height of cleaning elements 108 may prevent tissue cleanser 109 from reaching the intended oral tissue.

Tissue cleanser 109 is generally configured with a multiplicity of tissue engaging elements 111 (FIGS. 1-3), which in the construction are formed as nubs, and which will be described hereinafter for purposes of simplicity as "nubs." As used herein a "nub" is generally meant to include a column-like protrusion (without limitation to the cross-sectional shape of the protrusion) which is upstanding from a base surface. In a general sense, the nub, in the preferred construction, has a height that is greater than the width at the base of the nub (as measured in the longest direction). Nevertheless, nubs could include projections wherein the widths and heights are roughly the same or wherein the heights are somewhat smaller than the base widths. Moreover, in some circumstances (e.g., where the nub tapers to a tip or includes a base portion that narrows to a smaller projection), the base width can be substantially larger than the height.

Nubs 111 enable mechanical removal of microflora and other debris from the tongue and other soft tissue surfaces within the mouth. The tongue, in particular, is prone to develop bacterial coatings that are known to harbor organisms and debris that can contribute to bad breath. This microflora can be found in the recesses between the papillae on most of the tongue's upper surface as well as along other soft tissue surfaces in the mouth. When engaged or otherwise rubbed against a tongue surface, for example, nubs 111 provide for gentle engagement with the soft tissue while reaching downward into the recesses of adjacent papillae of the tongue. The elastomeric construction of tissue cleanser 109 also enables the head 104 to follow the natural contours of the oral tissue surfaces, such as the tongue, cheeks, lips, and gums of a user. Moreover, the nubs 111 are preferably soft so as to flex as needed to traverse and clean the tissue surfaces in the mouth. In one configuration, nubs 111 are able to flex and bend from their respective vertical axes as lateral pressure is applied during use. This flexing enhances the comfort and cleaning of the soft tissue surfaces.

As seen in FIGS. 1-3, one arrangement of tissue cleanser 109 includes nubs 111 that are conically or substantially conically shaped, although other configurations are contemplated. As used herein, "conically shaped" or "conical" is preferably meant to include true cones, frusto-conically shaped elements, and other shapes that taper to a narrow end and thereby resemble a cone irrespective of whether they are uniform, continuous in their taper, or have rounded cross-sections. With reference to FIG. 2, the base portion 113 of the conically shaped tissue engaging elements 111 is larger than the corresponding tip portion 115 and has a wider cross-sectional area to provide effective shear strength to withstand the movement of the tissue cleanser 109 along a soft tissue surface. The preferably smaller width or diameter of the tip portion 115 in conjunction with the length of the conically shaped nub 111 enable the nubs 111 to sweep into the recesses of the tongue and other surfaces to clean the microbial deposits and other debris from the soft tissue surfaces. Further, this construction effectively enables the oral medicament to enter the recesses of the adjacent papillae of the tongue for antibacterial treatment.

In a preferred construction, the thickness or width of the base of the nub 111 is 0.64 mm, and preferably within the range from about 0.51 mm to about 2.00 mm. Tip 115 of the nub 111 is 0.127 mm in width and preferably within a range from about 0.0.10 mm to about 0.75 mm for optimal penetration between the recesses of papillae of a user's tongue. The length or height of the nubs 111, as measured from base surface 113 to tip 115, is preferably 0.91 mm and preferably within range from about 0.5 mm to about 2.5 mm, and most preferably range between 0.75 mm to 1.5 mm. It should be recognized that the foregoing dimensions are provided to generally correspond to the typical anatomy of a human tongue which does not deviate significantly from the norm. Nevertheless, nubs 111 of other sizes and shapes outside the given ranges can be used.

As seen in FIG. 3, nubs 111 may be disposed in concentric rings, rows or loops 117 at spaced radial distances from the center of the head 104. This configuration encourages natural small circular motions on the tongue surface and other soft tissues to effectively clean the tissue and promote a user's salivary flow to release a releasable material into the mouth. Further, the motion of the head and nub construction helps force the releasable material into the adjacent papillae of the tongue. In one preferred construction, nubs 111 on adjacent rings 117 may be radially aligned. For example, adjacent rings 117 may have nubs 111 that are directly behind each other. A first nub 111 is said herein to be "directly behind" a second nub 111 when it is located within the lateral bounds of the second nub extending in a radial direction. In an alternative arrangement, the adjacent rings 117 can be in a staggered arrangement where the nubs 111 are not directly radially behind another nub. These configurations enable improved cleaning of the soft tissue surfaces by facilitating the removal of microflora and other debris and providing the oral medicament especially in the recesses of adjacent papillae of the tongue. Nonetheless, the nubs 111 could be arranged randomly or in a myriad of different ordered patterns.

Figure 4:
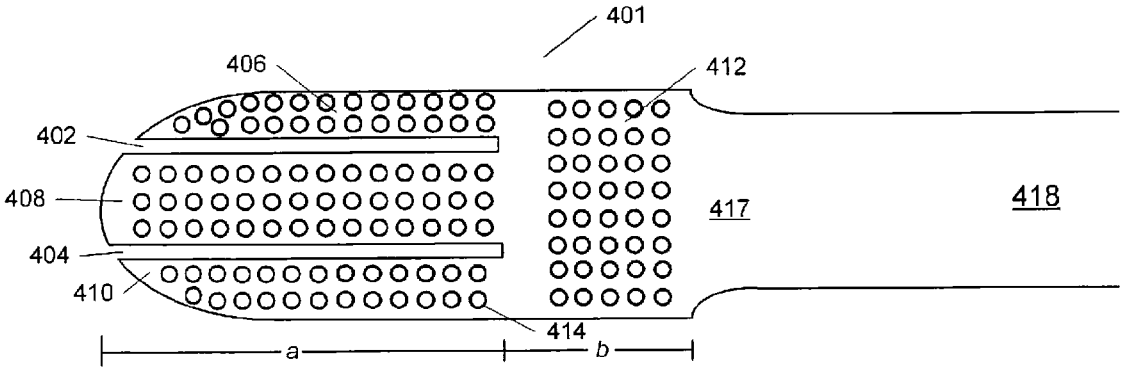
FIG. 4 is a rear view of a toothbrush having multiple flexible regions according to one or more aspects of an illustrative embodiment.

According to one aspect, a toothbrush head supporting tissue cleanser elements may be divided into independent tissue cleaning regions as shown in FIG. 4. In particular, toothbrush head 401 may include multiple splits 402, 404 that allows regions 406-410 to flex independently of the other regions. Such a configuration allows toothbrush head 401 and tissue cleanser elements 414 and tooth cleaning elements to flex to match the contours of the oral areas being cleaned (e.g., tongue curvatures, grooves in teeth). In the configuration illustrated in FIG. 4, splits 402 and 404 extend from a distal longitudinal end of toothbrush head 401 (opposite handle 418) a distance less than the entire length of head 401. In one arrangement, the length of head 401 may be defined by a region of the toothbrush having tooth or tissue cleansing elements. This configuration allows head 401 to maintain a substantially non-flexible region, i.e., region 412, proximate to neck 417 and handle 418 while allowing finger-shaped regions 406, 408 and 410 to flex independently. Thus, for oral regions that might require heavier cleansing, the non-flexible region 412 may be used instead of or in addition to flexible finger-shaped regions 406, 408 and 410. While splits 402 and 404 are described as being longitudinal, splits 402 and 404 may also be disposed laterally. For example, splits 402 and 404 may extend from one lateral end of head 401 a distance less than the entire width of head 401.

As discussed, longitudinal splits 402 and 404 do not extend the entire length of head 401. However, longitudinal splits 402 and 404 extend far enough into the toothbrush head to allow for sufficient flexibility and to provide a sufficiently large non-flexible area. Thus, in one or more arrangements, the ratio of the length of the split region (a) to the length of the non-split region (b) may fall between a range of 1:1 to 3:1, inclusive. Using a ratio falling between this range allows for sufficient flexibility in the split regions to match oral contours while maintaining adequately sized non-flexible region for cleaning various oral areas.

In the illustrated configuration of FIG. 4, the arrangement of tissue cleansing elements 414 (e.g., nubs) is region-centric. That is, the arrangement or configuration of tissue cleansing elements 414 may be specific to the region in which they are located. For example, in FIG. 4, tissue cleansing elements 414 are configured as a series vertically and horizontally aligned rows in regions 408 and 412, whereas in regions 406 and 410 the tissue cleansing elements 414 are aligned with the contour of the head. Alternatively, the arrangement of tissue cleansing elements 414 might be randomly placed or arranged based on an overall head configuration.

Figure 5:
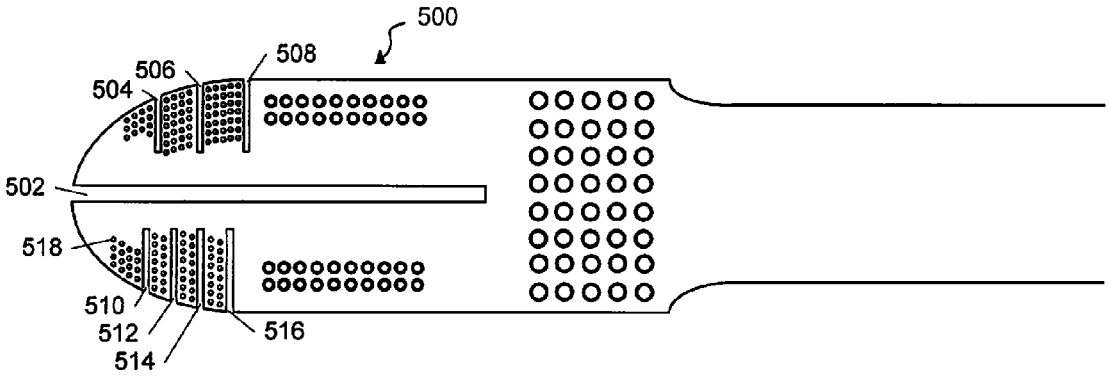
FIG. 5 is a rear view of a toothbrush having an asymmetrical configuration according to one or more aspects of an illustrative embodiment.

FIG. 5 illustrates another toothbrush head configuration having an asymmetric arrangement of splits 502-516. The toothbrush head 500 includes a central longitudinal split 502 that extends approximately half of the length of head 500. Further, each of the regions formed by longitudinal split 502 includes a number of lateral splits. In particular, the left region or portion of split 502 (according to the orientation shown in FIG. 5) may include more splits (i.e., splits 504-508) spaced more closely together than the right region or portion of split 502. This configuration allows a user to use one side (i.e., the right side) of toothbrush head 500 for areas that are more contoured, requiring finer flexion of tissue cleansing elements 518 (provided by the closer spacing of splits 504-508), and another side for flatter and less contoured areas. While the addition of longitudinal split 502 provides an additional degree of flexion, longitudinal split 502 might not be included depending on the needs and preferences of a user. Other asymmetric configurations of splits may also be used to create different types of cleansing regions.

Figure 6:
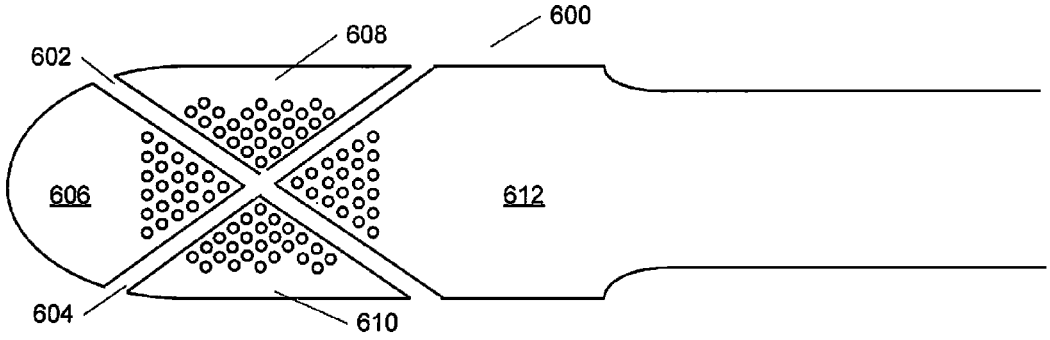
FIG. 6 is a side view of an alternative embodiment of the toothbrush of the present invention.

FIG. 6 illustrates yet another toothbrush head configuration. Toothbrush head 600 includes two criss-crossing splits 602 and 604 that extend diagonally across head 600. Split 602 intersects split 604. In one or more arrangements, one split may bisect the other split. While splits 602 and 604 are illustrated as extending from one edge of head 600 to another, it is to be understood that one or more of splits 602 and 604 might not extend all the way to a second edge. Splits 602 and 604 create three flexible cleansing regions or portions 606, 608 and 610 and one non-flexible cleansing region 612. Such an arrangement may be better suited to fit the contours of various oral regions such as the tongue or an inner cheek.

Figure 7:
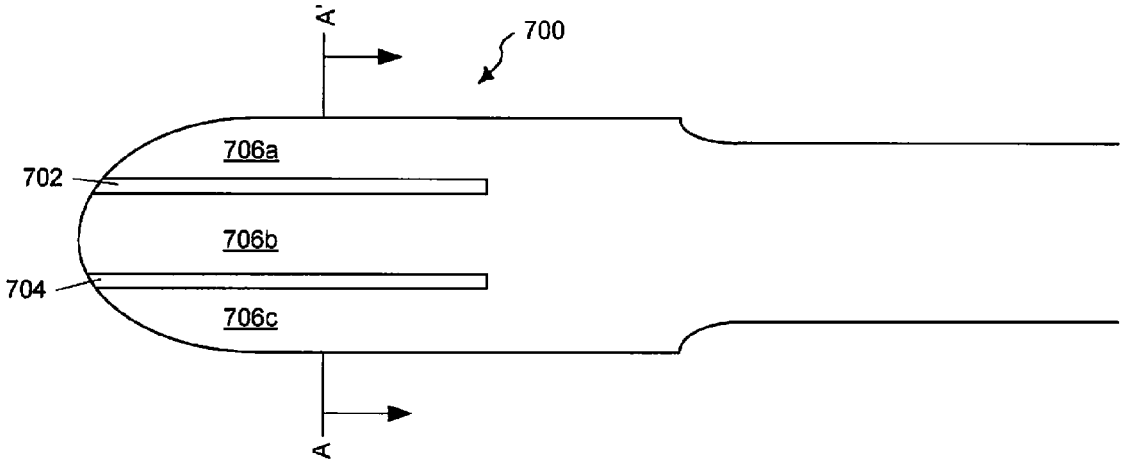
FIG. 7 illustrates a toothbrush head having splits filled with a flexible material according to one or more aspects described herein.

While many of the splits described herein have been illustrated and described as linear, splits may be formed as curves, zigzags and the like. Additionally, splits may be of any width. In some instances, the splits may be filled with an elastomeric or other flexible material, thus connecting the two regions of the oral care implement divided by the split. This may provide additional flexibility to the split regions. In addition, using elastomeric or other flexible materials to connect regions of a toothbrush head allows splits to carve out entire regions. For example, FIG. 7 illustrates toothbrush head 700 with splits 702 and 704. Splits 702 and 704 are filled with an elastomeric material that connects flexible regions 706*a* 706*b*, 706*c* to one another. Further, in one or more configurations, tissue cleansing nubs may also be formed on the elastomeric filler in the splits (not shown) to provide additional cleaning.

Figure 8:
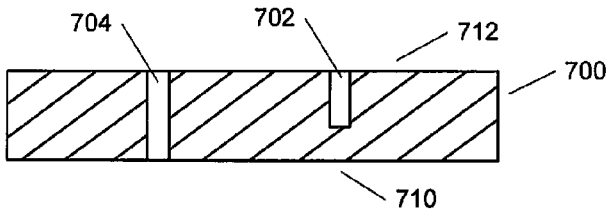
FIG. 8 is a cross-sectional view of the toothbrush of FIG. 7 taken along line A-A'.

FIG. 8 illustrates a cross-sectional view of toothbrush head 700 taken along section A-A'. While split 704 extends through the entire depth of toothbrush head 700, split 702 extends only partially through. Using a partial split such as split 702 may provide more flexibility in a first direction (i.e., toward the split) and less flexibility in a second direction (i.e., away from the split). Thus, a toothbrush head such as head 700 may provide firmer cleaning on a tooth cleaning side 710 while allowing for more flexible cleaning on a tissue cleansing side 712. The extent to which split 702 may extend through toothbrush head 700 without reaching the other side may be based on the strength and stiffness of the toothbrush head material and a desired maximum sustainable force (without breakage). The split 702 may extend through at least 98% of the thickness of the head 700, depending upon the materials selected.

While a description of a preferred embodiment of the tissue cleanser has been discussed, it should be understood that benefits of the invention can still be obtained with a wide variety of tissue cleanser constructions. For example, the tissue engaging elements may be in forms other than nubs, such as, for example, ridges or hemispheres. The tissue engaging elements may be formed on one side, a part of a side or sides, on both of the sides or the entire periphery of the tissue cleanser. Finally, the tissue cleanser may be formed of a non-elastomeric material or a combination of different materials.

The inventive aspects may be practiced for a manual toothbrush or a powered toothbrush. In operation, the previously described features, individually and/or in any combination, improves cleaning performance of toothbrushes. These advantages are also achieved by the cleaning elements and the synergistic effects. For example, the flexible regions of a toothbrush head may include vibratory, oscillating or reciprocating action that further improves cleaning. While the various features of the toothbrush 100 work together to achieve the advantages previously described, it is recognized that individual features and sub-combinations of these features can be used to obtain some of the aforementioned advantages without the necessity to adopt all of these features. This unique combination of elements improves and enhances cleaning and teeth whitening performance of toothbrushes. It is understood that designations such as "first" and "second" are for illustrative purposes and can be interchanged.

While the invention has been described with respect to specific examples including presently preferred modes of carrying out the invention, those skilled in the art will appreciate that there are numerous variations and permutations of the above described systems and techniques. Thus, the spirit and scope of the invention should be construed broadly as set forth in the appended claims.

The invention claimed is:

1. An oral care implement, comprising:

a head comprising a first face and a rear face opposite the first face;

a first longitudinal split extending a distance less than an entire length of the head and extending through an entire depth of the head;

a second longitudinal split extending only partially through the depth of the head, wherein the first and second longitudinal splits extend from a distal end of the head opposite an end of the head proximate to a neck of the oral care implement; and a plurality of first cleaning elements on the first face of the head.

2. The oral care implement of claim 1, wherein the first and second longitudinal splits are filled with a flexible material.

3. The oral care implement of claim 1, further comprising a plurality of tissue engaging elements extending from the rear face of the head.

4. The oral care implement of claim 1, wherein the second longitudinal split is parallel to the first longitudinal split.

5. The oral care implement of claim 1, wherein the head includes at least one flexible finger-like region and at least one non-flexible region.

6. The oral care implement of claim 5, wherein the at least one flexible finger-like region includes at least one additional split.

7. The oral care implement of claim 5, wherein a ratio of a length of the at least one flexible finger-like region to a length of the at least one non-flexible region is between 1:1 and 3:1.

8. An oral care implement, comprising:

a head comprising a first face, a rear face opposite the first face, and at least one split that is filled with an elastomeric material, wherein the at least one split is configured to create an asymmetrical arrangement of flexible and non-flexible regions in the head;

a plurality of first cleaning elements on the first face of the head; and a plurality of tissue engaging elements extending from the rear face of the head.

9. The oral care implement of claim 8, wherein the at least one split extends only partially into the head.

10. An oral care implement, comprising:

a head comprising a first face, a rear face opposite the first face, and at least one split, wherein the at least one split is configured to create an asymmetrical arrangement of flexible and non-flexible regions in the head;

a plurality of first cleaning elements on the first face of the head;

a plurality of tissue engaging elements extending from the rear face of the head; and wherein the at least one split extends diagonally across the head with respect to a longitudinal axis of the oral care implement.

11. An oral care implement, comprising:

a head comprising a first face, a rear face opposite the first face, and at least one split, wherein the at least one split is configured to create an asymmetrical arrangement of flexible and non-flexible regions in the head;

a plurality of first cleaning elements on the first face of the head; and a plurality of tissue engaging elements extending from the rear face of the head; and wherein the head comprises a second split, wherein the second split bisects the at least one split.

12. An oral care implement, comprising:

a head comprising a first face, a rear face opposite the first face, and at least one split, wherein the at least one split is configured to create an asymmetrical arrangement of flexible and non-flexible regions in the head;

a plurality of first cleaning elements on the first face of the head; and a plurality of tissue engaging elements extending from the rear face of the head; and wherein the head includes a second split, wherein the at least one split is a longitudinal split and the second split is a lateral split.

13. An oral care implement comprising:

a head including a central longitudinal split, the central longitudinal split dividing the head into a first region and a second region, each of the first and second regions including a plurality of lateral splits, and wherein the first region has more lateral splits than the second region; and a plurality of first cleaning elements on a first face of the head.

14. The oral care implement of claim 13, wherein the lateral splits of the first region are closer together than the lateral splits of the second region.

15. The oral care implement of claim 13, wherein the central longitudinal split extends only partially into the head.

16. An oral care implement comprising:

a head having a longitudinal axis and comprising a front face and an opposing rear face;

a pair of criss-crossing splits that intersect one another and extend diagonally across the head relative to the longitudinal axis; and a plurality of tooth cleaning elements on the front face of the head.

17. The oral care implement of claim 16 wherein the pair of criss-crossing splits create three flexible cleaning regions on the head and one non-flexible cleaning region on the head.

18. The oral care implement of claim 17 further comprising a handle coupled to the head, and wherein the non-flexible cleaning region is a portion of the head that is adjacent the handle.

19. The oral care implement of claim 16 wherein the pair of criss-crossing splits extend through an entirety of a depth of the head and are filled with an elastomeric material.

* * * * *